United States Patent [19]

Suzuki

[11] 4,262,707

[45] Apr. 21, 1981

[54] METHOD FOR INJECTING TRANSPORT FLUID INTO A SHED FROM AUXILIARY JET NOZZLES

[75] Inventor: Hajime Suzuki, Anjyo, Japan

[73] Assignee: Kabushiki Kaisha Toyoda Jidoshokki Seisakusho, Kariya, Japan

[21] Appl. No.: 9,733

[22] Filed: Feb. 5, 1979

[30] Foreign Application Priority Data

Feb. 10, 1978 [JP] Japan ..... 53/14448

[51] Int. Cl.[3] ..... D03D 47/28

[52] U.S. Cl. ..... 139/435

[58] Field of Search ..... 139/435; 226/95, 97

[56] References Cited

U.S. PATENT DOCUMENTS

| | | | |
|---|---|---|---|
| 3,229,725 | 1/1966 | Saito | 139/435 |
| 3,705,608 | 12/1972 | Vermeulen | 139/435 |
| 3,821,972 | 7/1974 | Svaty et al. | 139/435 |
| 4,020,887 | 5/1977 | Spisiak et al. | 139/435 |
| 4,143,681 | 3/1979 | Kuda et al. | 139/435 |

FOREIGN PATENT DOCUMENTS

| | | | |
|---|---|---|---|
| 2328135 | 12/1974 | Fed. Rep. of Germany | 139/435 |

*Primary Examiner*—Henry Jaudon

*Attorney, Agent, or Firm*—Wenderoth, Lind & Ponack

[57] ABSTRACT

A method for injecting a transport fluid into a shed from a plurality of auxiliary jet nozzles is disclosed. In general, the auxiliary jet nozzles successively discharge the jets of fluid in time with advancement of a weft thread through the shed to thereby assist the weft in being transported with a jet of fluid launched by a main jet nozzle. According to the invention, the periods of time of discharge of the auxiliary jet nozzles are prolonged with the advancement of the weft through the shed.

5 Claims, 3 Drawing Figures

METHOD FOR INJECTING TRANSPORT FLUID INTO A SHED FROM AUXILIARY JET NOZZLES

BACKGROUND OF THE INVENTION

This invention relates to a jet loom, and more particularly to a method for injecting a transport fluid into a shed from auxiliary jet nozzles of the jet loom, wherein a weft thread is inserted into the shed by using the jets of injected fluid under pressure.

Generally, in a jet loom of such type, a main jet nozzle alone can not transport the leading end of the weft to a distance at a sufficient speed, so that a suitable number of auxiliary jet nozzles are provided on a reed to each produce a flow of air in cooperation with the main jet nozzle. However, if all the auxiliary jet nozzles are always operated, a great total consumption of air results. In order to reduce the total consumption, U.S. Pat. No. 3,705,608 has proposed to energize the auxiliary jet nozzles successively or in successive groups in time with the advancement of the leading end of the weft thread through the shed. Because each auxiliary jet nozzle is operated for the same period of time as the others, the injection timing of the auxiliary jet nozzles has to be adjusted when a transport speed of the weft is varied due to changes in thickness, kind of material and degree of fluffiness of the weft, and due to changes in operation speed of the loom. More specifically, in order to allow the weft to be effectively subjected to the function of the jets from the auxiliary jet nozzles, it is required that the injection timing of the auxiliary jet nozzles be advanced when the weft is transported at a higher speed and delayed when the same is transported at a lower speed.

Furthermore, even if weaving conditions are maintained unchanged, both the transport speed and the path of the weft will be subject to fluctuations each time a weft insertion operation is carried out, and the fluctuations will be gradually increased toward the end of one weft inserting operation. This causes the injection timing of the auxiliary jet nozzles to become out of time with the advancement of the weft leading end, thus resulting in the weft not being inserted.

It is therefore a principal object of this invention to provide a method for injecting a transport fluid into a shed from auxiliary jet nozzles, which requires no adjustment of the injection timing of the auxiliary jet nozzles even when weaving conditions are changed.

SUMMARY OF THE INVENTION

With the above object in view, this invention resides in a method for injecting a transport fluid into a shed from a plurality of auxiliary jet nozzles, which successively discharge jets of fluid in time with the advancement of a weft thread through the shed, to thereby assist the weft in being transported with a jet of fluid launched by a main jet nozzle, characterized in that the periods of time of discharge of the auxiliary jet nozzles are prolonged with the advancement of the weft through the shed.

BRIEF DESCRIPTION OF THE DRAWINGS

This invention will become more readily apparent from the following description of a preferred embodiment thereof shown, by way of example only, in the accompanying drawings in which.

DESCRIPTION OF THE PREFERRED EMBODIMENT

Figure 1:
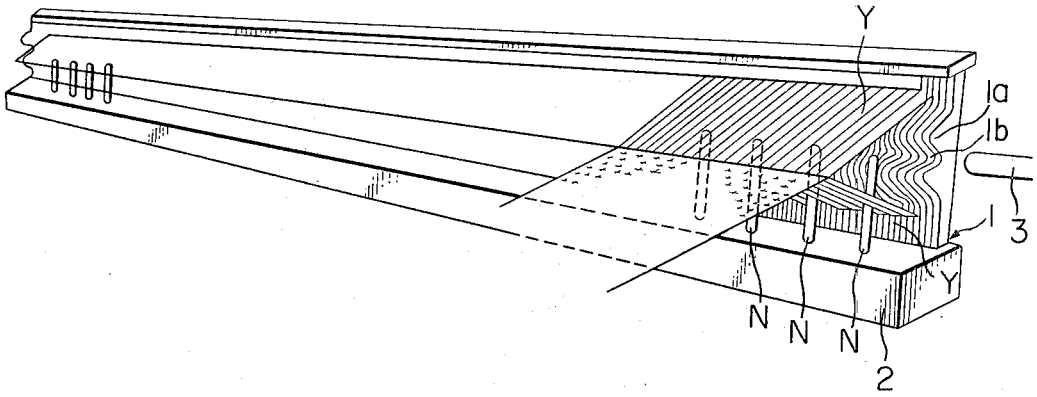
FIG. 1 is a perspective view of a weaving reed to which this invention is applicable.
Figure 2:
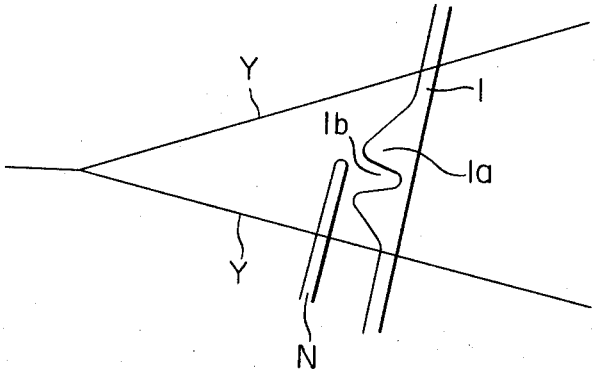
FIG. 2 is a diagrammatic view of the reed looking toward the left in FIG. 1.

Referring now to the drawings, particularly to FIGS. 1 and 2, there is shown a reed 1 having a plurality of equi-spaced guide plates 1*a* perpendicularly mounted on a reed frame 2. Disposed adjacent the endmost guide plate 1*a* is a main jet nozzle 3, which may be connected to a supply of pressurized air (not shown) and discharges a jet of air under high pressure to transport a weft thread, which has been threaded into the main jet nozzle 3, through a shed defined by upper and lower warp sheets Y and the reed 1. The reed frame 2 also has mounted perpendicularly thereon a plurality of equi-spaced auxiliary jet nozzles N, each of the auxiliary jet nozzles N being constructed and arranged in a conventional manner so that the upper end portion thereof is positioned adjacent a guide path 1*b* formed by the guide plates 1*a*, thereby allowing the jet of air under pressure discharged therefrom in the direction, in which the weft is to be transported, to assist the weft in being transported through the guide path 1*b*.

Although a jet loom is generally provided with ten or more auxiliary jet nozzles, the method according to this invention will be described, only by way of example, with reference to an embodiment employing eight auxiliary jet nozzles N1 to N8.

Figure 3:
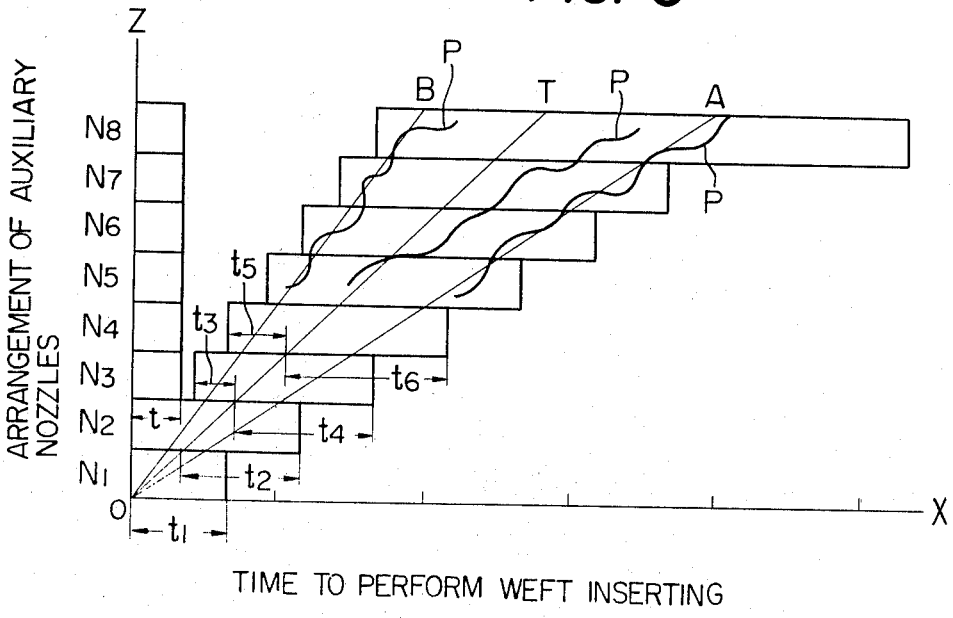
FIG. 3 is a diagram explaining the timing of operation of auxiliary jet nozzles obtained in accordance with the teachings of the present invention.

In the diagram of FIG. 3, a time to perform a weft inserting operation is drafted on the abscissa X, and a width of auxiliary jet nozzle arrangement is shown on the ordinate Z. Assuming that the weft thread travels at normal constant speed, its leading end will be transported along the straight line OT, wherein a point O is a point in time at which transportation of the weft by the first auxiliary jet nozzle N1 starts, and a point T is a point in time at which the leading end of the weft has just passed through the shed. However, it is to be noted that transportation of the weft to the first auxiliary jet nozzle N1 has been carried out by the jet from the main jet nozzle 3, and that the air injection from the first auxiliary jet nozzle N1 commences simultaneously with the main jet nozzle 3.

At the beginning of the weft inserting operation, the main jet nozzle 3 injects the weft together with the jet of high pressure air to transport the weft into the shed, and at the same time, in addition to the first and second jet nozzles N1 and N2, the auxiliary jet nozzles N3 to N8 are operated for a predetermined short period of time t to discharge the jets simultaneously, whereby the flow of air is established along the overall length of the weft path in the shed.

Then, the third to eighth auxiliary jet nozzles N3 to N8 are made inoperative to discontinue the simultaneous discharges therefrom, while the first auxiliary jet nozzle N1 further discharges the jet of for a period of time t1 (>t) to assist the weft in being transported near the first auxiliary jet nozzle N1. With respect to the second auxiliary jet nozzle N2, it further continues to discharge the jet of air for a predetermined period of time t2 (>t1)even after it is passed by the weft.

Before the weft leading end reaches a position adjacent the third auxiliary jet nozzle N3 and immediately after the jet nozzles N3~N8 are rendered inoperative, the third jet nozzle N3 is again operated for a predetermined period of time t3+t4 (t4>t2), wherein at the end of t3 the weft leading end passes beside the third jet nozzle N3.

The weft leading end then reaches a position adjacent the fourth jet nozzle N4. However, the fourth jet nozzle N4 is again operated for a period of time t5 (t5>t3) in advance prior to arrival of the weft leading end to the fourth jet nozzle N4 and continues to discharge the jet for a period of time t6 (>t4) after the arrival of the same.

The fifth to eighth jet nozzles N5 to N8 also can be operated in the same manner as the third and fourth jet nozzles N3 and N4. That is, they are made operative successively in phase overlapped relationship so that each succeeding auxiliary jet nozzle is operative for a longer period of time than the adjacent preceding auxiliary jet nozzle to thereby assist the weft leading end in being transported beside the jet nozzles N5 to N8. In addition, it is seen from FIG. 3 that a period of time, during which the compressed air is discharged from the last jet nozzle N8, is prolonged in order to provide a certain tension in the weft until it is beaten up.

Where the transport speed of the weft is decreased due to changes in thickness, kind of material, degree of fluffiness of the weft and changes in operation speed of the loom, the time necessary to complete one weft insertion operation will be prolonged as shown by the line OA in FIG. 3. Even then, all the jets injected from the auxiliary jet nozzles N1 to N8 will be able to serve to effectively transport the weft leading end through the shed. In contrast to the above, where the transport speed of the weft is increased due to changes in weaving conditions of the loom, the time to perform one weft insertion operation will be shortened as understood from the line OB shown in FIG. 3. Under this condition, all the jets injected from the auxiliary jet nozzles N1 to N8 also will be able to serve to effectively transport the weft leading end through the shed. Thus, in any case, there is no need to adjust the injection timing of the auxiliary jet nozzles N1 to N8.

Actually, during one weft inserting operation, the speed of the weft leading end varies as the leading end advances through the shed. Therefore, although the leading end actually follows a line P, all the jets injected from the auxiliary jet nozzles N1 to N8 serve to effectively transport the weft leading end in the same manner. Thus, there is no need to adjust the injection timing of the auxiliary jet nozzles N1 to N8.

In addition, even when the leading end of the weft advances at constant speed as shown by the lines OA, OT and OB, a widthwise position of the leading end in the shed at any point of time during the weft inserting operation changes with the transport speed of the weft. And, an amount of change gradually increases as the weft leading end advances toward the end of the shed remote from the main jet nozzle. The method according to the invention can accommodate such a change in widthwise position of the weft, since a period of injection time for each succeeding auxiliary jet nozzle is more prolonged than the preceding auxiliary jet nozzles.

In the illustrated embodiment, all the auxiliary jet nozzles N1 to N8 are adapted to be simultaneously operated at the beginning of the weft inserting operation, thus providing a flow of pressure air along the overall length of the weft path in the shed. This causes the weft thread launched by the main jet nozzle to be transported smoothly through the shed. In this respect, it is to be noted that, where the auxiliary jet nozzles N1~N8 are operated successively during the normal weft inserting operation without the simultaneous air supply from all the jet nozzles N1~N8 at the beginning of the weft inserting operation, vortexes will occur locally in the flow of compressed air from each auxiliary jet nozzle, which vortexes prevent a smooth weft insertion operation. However, in the illustrated embodiment, the flow of air is first established along the overall length of the shed to provide a minimum amount of turbulence, thus resulting in most favourable weft inserting conditions.

Especially, even when the loom is in one picking motion or operated at a low speed (at that time the auxiliary jet nozzles operated in synchronism with the weaving motion of the loom are delayed in injection timing relative to the advancement of the leading end of the weft) such, for example, as during the preparatory operation immediately after looming, when it is necessary to re-insert a new weft after the weft breakage, when it is necessary to observe an inserting condition of the new weft before the normal operation re-starts, when it is necessary to confirm the position of the cloth fell upon occurrence of trouble, and when it is necessary to observe a condition by giving one picking motion to the loom, the weft insertion operation can be accomplished without error because the flow of air is established along the overall length of the weft path in the shed.

However, the above-described step of simultaneously injecting the jets from all of the auxiliary jet nozzles may be performed at any point of time in the course of the weft inserting operation and may be eliminated because it is not essential to the invention.

It is therefore apparent that the present invention has provided a method for injecting a transport fluid into a shed from auxiliary jet nozzles, which requires no adjustment of the injection timing of the auxiliary jet nozzles even when weaving conditions are changed.

What I claim is:

1. In a method for inserting a weft thread through a shed of a jet loom by the steps of launching said weft thread by a fluid jet from a main jet nozzle, thereby initiating insertion of said weft thread through said shed, and successively and sequentially discharging separate fluid jets from respective auxiliary jet nozzles spaced along the full length of the path of said weft thread through said shed, thereby assisting said main jet nozzle in inserting said weft thread through said shed, the improvement comprising:

establishing periods of time during which said separate fluid jets are progressively discharged from each said respective auxiliary jet nozzle such that the lengths of said periods of time are sequentially progressively increased in the direction of the weft thread insertion along said path of said weft thread through said shed.

2. The improvement claimed in claim 1, wherein said periods of time are established without adjustment of relative times of initiation and termination of operation of any of said auxiliary jet nozzles during normal variations in insertion speed of said weft thread.

3. The improvement claimed in claim 1, wherein said periods of time are established to be progressively phase overlapped.

4. The improvement claimed in claim 1, further comprising simultaneously discharging fluid jets from all of said auxiliary jet nozzles at the beginning of the weft thread insertion operation.

5. The improvement claimed in claim 1, further comprising simultaneously discharging fluid jets from all of said auxiliary jet nozzles during the course of the weft thread insertion operation.

* * * * *